United States Patent [19]

Christner et al.

[11] Patent Number: 4,889,811

[45] Date of Patent: Dec. 26, 1989

[54] METHODS FOR MAKING LEATHER

[75] Inventors: Juergen Christner, Bickenbach; Ernst Pfleiderer, Darmstadt; Tilmann Taeger, Griesheim, all of Fed. Rep. of Germany

[73] Assignee: Röhm GmbH, Darmstadt, Fed. Rep. of Germany

[21] Appl. No.: 905,706

[22] Filed: Sep. 9, 1986

[30] Foreign Application Priority Data

Sep. 18, 1985 [DE] Fed. Rep. of Germany ..... 3533203

[51] Int. Cl.[4] ..... C14C 1/00; C14C 3/00; C14C 5/00

[52] U.S. Cl. ..... 435/265; 435/262; 8/94.1 R; 8/94.1 P; 8/94.15; 8/94.18; 8/94.19 R; 8/94.2

[58] Field of Search ..... 435/262; 8/94.1 R, 94.15, 8/94.19 R, 94.2

[56] References Cited

U.S. PATENT DOCUMENTS

| | | | |
|---|---|---|---|
| 3,133,002 | 5/1964 | Grimm | 195/6 |
| 3,248,457 | 4/1966 | D'Alelio | 8/94.1 |
| 3,939,040 | 2/1976 | Monsheimer et al. | 195/6 |
| 4,186,028 | 1/1980 | Woditsch et al. | 106/300 |
| 4,273,876 | 6/1981 | Monsheimer et al. | 435/265 |
| 4,278,432 | 7/1981 | Monsheimer et al. | 8/94.18 |
| 4,314,801 | 2/1982 | Monsheimer et al. | 8/94.14 |
| 4,344,762 | 8/1982 | Monsheimer et al. | 8/94.18 |
| 4,465,802 | 8/1984 | Dennen et al. | 524/395 |

FOREIGN PATENT DOCUMENTS

| | | |
|---|---|---|
| 1359867 | 12/1971 | United Kingdom . |
| 1450231 | 1/1974 | United Kingdom . |
| 1450232 | 9/1976 | United Kingdom . |

OTHER PUBLICATIONS

Nomenclature of Organic Chemistry, 1979 Edition, Rigaudy et al., Pergamon Press, New York, pp. 392 and 395.

The Encyclopedia of Chemistry, Third edition, edited by Hampel et al., Van Nostrand Reinhold Company, N.Y., p. 1073.

*Primary Examiner*—Robert J. Warden
*Assistant Examiner*—Janelle Graeter
*Attorney, Agent, or Firm*—Curtis, Morris & Safford

[57] ABSTRACT

Methods for making leather from animal hides and skins in the presence of surface active agents wherein certain phosphonic acid compounds are used in place of, or in combination with, known surface active agents.

16 Claims, No Drawings

METHODS FOR MAKING LEATHER

The present invention relates to methods for making leather using phosphonic acid compounds as auxiliary agents and relates particularly to wet operations in leather manufacture employing such compounds as surface active agents.

THE PRIOR ART

In certain process operations of leather manufacture, and particularly in the beamhouse, at least some of the additives used with the aqueous floats are wetting agents. These surface active agents have the effect of decreasing the surface tension of the water relative to the skin and hence of increasing the latter's wettability. This wetting effect aids the soaking action, for example, in the soaking step. (See F. Stather, "Gerberchemie and Gerbertechnologie", p. 159, Akademie-Verlag, Berlin, 1967.) The wetting agents used in soaking include aliphatic and aromatic esters of sulfuric acid, sulfonic acids and their salts, hydroaromatic compounds, and aliphatic and aromatic amines and their salts, even in low concentrations, for example from 1 to 2 grams/-liter. Acceleration of the soaking process serves mainly to prevent decomposition of the hide substance. Radioactive labeling has shown that the frequently used class of arylbenzene sulfates is taken up primarily by the grain side and the flesh side and then largely released during the course of the alkaline operations of leather manufacture. Inorganic polyphosphates have also been used as soaking aids.

The use of wetting agents is regarded as advantageous in the liming operation which usually follows soaking, and in the subsequent unhairing, since the agents enable the liming chemicals to penetrate into the skin in a minimum of time and permit a gentle opening up of the skin at a savings in sharpening agents. The fat dissolving action of wetting agents may also be a factor. Here, too, alkyl sulfates and alkylbenzene sulfonates are the most widely used. For painting, the same chemicals are generally used as in liming. The deliming and bating operations which follow involve the penetration of the deliming agents into, and the dissolving of the lime out of, the skin. (See Ullmanns Enzyklopaedie der technischen Chemie, 3rd ed., vol. 11, pp. 560–561, and 4th ed., vol 16, pp. 111–164.) Residual fat is also removed in bating.

In modern bating processes, enzymes are generally employed. In enzymatic bating, emulsifying surface active fatty alkyl sulfates are occasionally used concurrently.

Optionally, the pelts conditioned in the beamhouse are treated with a solution of acids and salts, the so-called pickle, before they are tanned. The concurrent use of polymeric inorganic phosphates in amounts from about 0.5 to 1 weight percent, based on the pickle, has also been proposed. As a rule, the use of disinfectants which also have a wetting action offers certain advantages. Surface active substances also find use in tanning itself. These substances, which include the dispersing and sludge-loosening lignin sulfonates, are classed as auxiliary tanning materials. (See K. Faber, vol. 3, "Gerbmittel, Gerbung und Nachgerbung" in Bibliothek des Leders", H. Herfeld, ed., Umschau-Verlag, Frankfurt, 1985.) Polyphosphates are used for pretanning, in neutralization, and for retailing.

Finally, the action of fatliquoring agents on leather is enhanced by the use of fatliquoring auxiliaries, which chemically are related to the emulsifiers and surfactants.

THE OBJECT

While the prior art opens up a wide variety of potential uses for surface active, emulsifying, and complexing agents in the manufacture of leather, individual applications are quite uncoordinated, especially insofar as the types and amounts to be used are concerned. The need for differentiated uses has to do with changes in the treating milieus, particularly changes in pH value, during the course of leather manufacture from soaking to finishing. These factors also make it difficult to integrate the auxiliaries as a whole into an ecological concept, which leather manufacturers will have to adopt just as other branches of industry.

In principle, reduced pollution with auxiliaries as with active chemical substances is undoubtedly to be preferred. In other areas of industry, for example in the detergent industry and in agriculture, undesirable ecological developments which have been linked to the pollution of waste waters have prompted drastic changes. Thus there has been a need for surface active auxiliaries suitable for all-around use in the manufacture of leather that would make possible a reduction of the quantities of surfactants consumed.

THE INVENTION

The teachings of the present invention go far toward meeting these technological requirements.

The invention relates to methods for the manufacture leather in which derivatives of phosphonic acids are used as leather auxiliaries particularly in the wet operations. These phosphonic acid compounds are characterized by the presence in the molecule of at least one

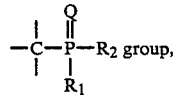

wherein Q represents oxygen or sulfur and $R_1$ and $R_2$ represent, independently of each other, —OH, —SH, or ammonium, as well as alkali metal or alkaline earth metal salts of such compounds, or represent $—NR_3R_4$, wherein $R_3$ and $R_4$ are hydrogen or alkyl having 1 to 6 carbon atoms. The phosphonic acid compounds preferably have at least one acidic —OH group per phosphorus atom, or a salt thereof. Moreover, the phosphonic acid compounds preferably have an advantageously tertiary, aliphatically substituted nitrogen atom (not located on the phosphorus atom) in the molecule. The phosphonic acid derivatives may further contain to advantage $—OR_3'$, $—SR_4'$, or —COOM substituents, $R_3'$ and $R_4'$ having the same meanings as $R_3$ and $R_4$, and M representing hydrogen, an ammonium ion, or an alkali metal or alkaline earth metal ion.

Apart from those groups names, the phosphonic acid derivatives generally contain no further functional groups and no hetero atoms. The molecular weight (in the acid form) usually is less than 1000, and perferably less than 600. By alkali metal salts are meant particularly the sodium and potassium salts, and by alkaline earth metal salts, the magnesium and calcium salts. As a rule, phosphonic acids have a complexing capacity for $CaCO_3$ from 200 to 700 mg/g of active substance.

Some of the phosphonic compounds to be used in accordance with the invention are commercially available. This is true of the derivatives of formula (I), for example.

Particularly preferred are phosphonic acid compounds of the general formula

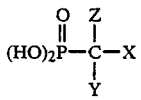

(I)

wherein Z and Y are hydrogen and X is

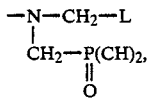

wherein L is

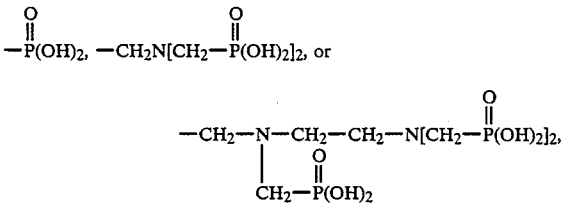

as well as the ammonium, alkali metal, or alkaline earth metal salts thereof (IA); or X represents $-CH_2COOH$ (IB); or wherein Z represents alkyl having 1 to 3 carbon atoms, preferably methyl, Y represents —OH, and X represents $-P(O)(OH)_2$ (IC); or wherein Z is hydrogen or —COOH, Y is $-CH_2COOH$, and X is $-(CH_2)_2COOH$ (ID).

Preferred alkali metal salts are the sodium and potassium salts, and preferred alkaline earth metal salts are the magnesium and calcium salts.

For the purposes of the present invention, ammonium salts include those derived from alkylamines and hydroxyalkylamines. The alkyl radicals generally should have up to 6 carbon atoms.

The use of phosphonic acid derivatives as leather auxiliaries in accordance with the present invention may extend (A) to beamhouse processes with the operations of
  (a) soaking,
  (b) hair loosening and opening up of the skin (liming or painting),
  (c) deliming and bating, and
  (d) pickling, or development of pickled sheepskins, that is to the production of hides and skins ready for tanning;

(B) to tanning itself, and in particular to the operations of
  (a) chrome tannage or
  (b) synthetic/vegetable quick tannage, and
  (c) combination tannage; and (C) to wet operations for finishing the leather, that is, to
  (a) neutralization of chrome leather,
  (b) retannage of chrome leather, and
  (c) dyeing and fatliquoring of chrome leather.

The use in accordance with the invention of phosphonic acid compounds is advantageously substantially in keeping with the established unit operations of the prior art as set forth above.

As a rule, these compounds are used in the same manner as the surface active agents described above under "The Prior Art". The amounts used should meet the specific requirements of the particular operation, as is always the case with the prior art surface active auxiliaries. The amounts to be used generally range from 0.01 to 5 percent, and preferably from 0.1 to 5 percent, by weight of the green hide, the pelt, or the leather forming the substrate in the particular operation. The phosphonic acids will usually be added to the floats or baths before the beginning of the respective treatment. Particularly preferred is the use of the compounds of the formula (IA):

Aminotrimethylene phosphonic acid (compound IA-1),

Ethylenediaminetetramethylene phosphonic acid (compound IA-2,)

Diethylenetriaminepentamethylene phosphonic acid (compound IA-3) or its salts, and particularly the sodium and potassium salts, and ethanol-1,1-diphosphonic acid, especially in the form of its salts, and particularly of the sodium salts (compound IC-1).

The individual operations will now be discussed in detail.

(A) (a) Soaking

Soaking is carried out conventionally, in the manner of a dirt-loosening soak and of a main soak. As is known, soaking prepares the dirt encrsted or cured and stored hide for further treatments, the salts being dissolved out of the hide structure and with the fibers then again taking up water. Soaking auxiliaries are advantageously added to the soak liquors. Soaking usually takes from 5 to 24 hours, the liquor being changed after 6 to 8 hours. Except for the use of surface active agents, the whole operation is best left unchanged. (See F. Stather, loc. cit., pp. 161–164, and Ullmanns, 4th ed., loc. cit., vol. 16. p. 118.)

The commonly used nonionic surface active agents (e.g. polyoxyalkylated alkylphenols) are advantageously replaced in whole or, preferably, in part by the phosphonic acid compounds of the invention.

The content of phosphonic acid derivatives of formula (I) will generally range from 0.01 to 3 percent by weight of the soak liquor. The content of surface active agents (which in the prior art ranges from 0.1 to 3 weight percent) can then be reduced by about one-third (as a guide) if the percentage of the phosphonic acid compound used represents from one-fifth to one-third of the percentage of surface active agent used.

On the whole, the dirt-loosening and increased swelling action is found to be at least as good.

Of special interest is that the phosphonic acid compound can be used in combination with enzymes, for example in the soaking operation and in bating. (See German patent No. 20 59 453 (=British 1,359,867), published German patent application No. DOS 29 44 462 (=U.S. Pat. No. 4,314,801), 29 44 461 (=U.S. Pat. No. 4,344,762) and 29 29 844, (=U.S. Pat. No. 4,278,432), U.S. Pat. No. 3,939,040, published German patent application DOS 28 56 320(=U.S. 4,273,876), and British Pat. Nos. 1,450,232 and 1,450,231.)

In the main soak, the effect of the soaking enzymes (e.g. bacterial proteases) is improved, that is, the soaking action (water absorption) is accelerated. For example, a water absorption that is from 10 to 20 percent faster can be observed.

With regard to fat extraction, the combination of phosphonic acid derivative and conventionally used surface active agent also offers advantages, for example a savings in surface active agent. For example, a combination of 0.05 weight percent of phosphonic acid compound and 0.15 weight percent of a conventional surface active agent, such as a polyethoxylated nonyl phenol, gives the same fat extraction values as the use of 0.3 weight percent of the conventional surfactant alone.

Soak floats loaded with the whole combination of enzyme, surfactant, and phosphonic acid derivative give fat values that are from 20 to 30 percent higher than those obtained with prior art enzyme soak liquors.

(A) (b) Liming

In liming, too, the addition of phosphonic acid derivatives has a favorable effect on the liming action without requiring any changeover in liming practice. As is known, liming serves to loosen the hair and to open up the skin for the purpose of removing the epidermis and other undesired skin constituents. The opening up of the skin also conditions it for further treatment. An alkaline liquor to which liming chemicals are added is used. (See F. Stather, loc. cit., pp. 166–199.) The lime liquor is mostly sharpened, that is a combination of calcium hydroxide and sodium sulfide or sodium hydrosulfide is used. The addition of buffering liming auxiliaries which reduce swelling is often advantageous.

For liming, the hide stock is traditionally suspended in the lime liquors in pits or together with a lime liquor kept in motion in drums or in tanning machines. Enzymatic liming processes are also receiving attention. (German patents 977 414, 10 23 183 and 12 03 416 (=U.S. 3,133,002)

In the light of the results obtained so far, additions of phosphonic acid compounds to the lime liquor significantly increase the dispersing of dirt and fat. Depending on the amount of phosphonic acid derivatives used, improved or more rapid sedimentation can be observed, which manifests itself in part in a reduction of the pollution load of the waste water from 25 to 30 percent, based on the COD (Chemical Oxygen Demand) value, and from 10 to 15 percent, based on the total nitrogen.

As a rule, the lime liquors advantageously contain from 0.01 to 3 percent, and preferably from 0.1 to 3 percent, of phosphonic acid compounds particularly of formula (IA), based on the salted weight. As a result, the calcium content of the pelt after liming is found to be 10 to 15 percent lower. This facilitates deliming and a softer leather is obtained. The use of the phosphonic acids of the invention in the form of their sodium salts in the lime rinse liquor helps to prevent the formation of lime blasts on the leathers. In addition, it reduces the calcium content of the washed pelts by about 10 percent. In the liming effluent, the phosphonic acids are used in accordance with the invention in amounts from 0.01 to 2 percent, based on the salted weight.

(A) (c) Deliming

An important field of application of the phosphonic acid derivatives of the invention is deliming. After liming, the dehaired and limed pelt must be brought from a pH of 13–14 to a pH of 8. In the process, the natural state of hydration of the soaked hide or skin is to be approximately restored. In this operation, weak to moderately strong organic acids or their ammonium salts, or the ammonium salts of strong inorganic acids alone, are used to advantage. It is important that the hide or skin which underwent alkaline swelling by calcium hydroxide is neutralized and substantially deswelled and that at the same time the calcium, bound in capillary or saltlike fashion to the collagen, is removed. Phosphonic acids, alone or in combination with the usual deliming agents, form readily soluble calcium salts (complex formation) and, depending on the amount used, reduce the calcium content of the pelt. The phosphonic acids are used in amounts from 0.01 to 5 percent, and preferably from 0.1 to 3 percent, based on the pelt weight, alone or in combination with other deliming agents such as organic acids and esters or ammonium salts. (See F. Stather, loc. cit., pp. 212–217.) The ammonium content of the products in accordance with the invention can be reduced to about one-half of what is is in commercial products. In deliming, the use of diethylenetriaminepentamethylene phosphonic acid (compound IA-3), hydroxyethane-1,1-diphosphonic acid (compound IC-1) or aminotrimethylene phosphonic acid (compound IA-1) is preferred.

(A) (d) Bating

A particularly advantageous application area for the phosphonic acid derivatives of the invention is bating, and particularly enzymatic bating. The function of bating is to loosen the collagen fiber structure, to peptize the individual fibers, and to remove unstructured proteins (keratin residues, albumins, and globulins) particularly from the area of the grain layer. The swelling or tension of the skin present even after deliming is neutralized and the skin is put in a quasi-"native" state. With the skin in this state, the tanning materials are able to penetrate it uniformly. Bating usually proceeds at 30° C. to 40° C. in a mildly agitated liquor under the action of proteolytic enzymes, and particularly of pancreatic and bacterial proteases. (See U.S. Pat. No. 3,939,040 and published German patent application DOS No. 28 56 320.)

In these process steps, the phosphonic acids, preferably in the form of the sodium salts of formula (IA), are added in amounts from 0.01 to 5 percent, based on salted weight, advantageously together with 0.1 to 3 weight percent of surfactant, preferably from the class of nonionic surface active agents. This makes it possible to obtain pelts freer of scud and with better loosening of the scud. The fat content of a bate liquor containing the combination of phosphonic acid and surfactant is up to 20 percent higher than that of a bate liquor containing only a proteolytic enzyme.

(B) Tanning

In pickling and chrome tanning operations, the phosphonic acid derivatives are preferably added after pickling and before chrome tanning, or simultaneously with the chromium.

In general, from 0.1 to 2 weight percent of the phosphonate compounds, and preferably of the disodium salt of ethanol-1,1-diphosphonic acid (compound IC-1), is used. In other respects, the operations are carried out as in the prior art.

The phosphonates may produce a slight pretannage, and in combination with the subsequent conventional chrome tanning (F. Stather, loc. cit., pp. 401–450, and Ullmanns, loc. cit., vol. 18, pp. 120–122) masking will occur, and hence a uniform distribution of chromium over the section. The leathers so obtained have a very fine, firm, and smooth grain and a softer and fuller feel.

The dispersing and sequestering action of the phosphonic acid derivatives helps to assure that, in the case of raw stock containing much natural fat, the latter will be well distributed and that no natural fat stains will develop.

(C) Finishing of Leather

In retannage operations, resin tanning agents based on urea, melamine, or dicyandiamide derivatives are used most widely. Frequently the retanning of chrome leather is done with synthetic tanning materials.

Retanning is advantageously carried out in the same operation as the dyeing and fatliquoring of the leathers. In retanning, the neutralized or deacidified and shaved chrome leather is kept in motion in the retanning liquor.

In the neutralization and retaining of chrome leather, very rapid uptake of the tanning material occurs and, when the cross section is tested with a bromocresol green solution, uniform coloration (as a manifestation of uniform pH conditions) is found throughout the thickness of the leather. If dyeing is carried out in accordance with the invention, even, bright shades are obtained. The lightening of the shade frequently encountered when syntans are used will not occur. The phosphonic acid derivatives used in accordance with the invention therefore are particularly well suited for use as leveling agents in dyeing. They are generally employed in amounts from 0.01 to 1 percent, based on the shaves weight.

With certain brown shades in particular, dyeing is intensified, which permits the amount of dye used to be reduced.

In fatliquoring, good takeup and a high degree of exhaustion of the liquor are observed. With the process of the invention, the operations of neutralization, chrome leather retanning, dyeing, and fatliquoring may also be based on the corresponding prior art operations.

The Phosphonic Acid Compounds

The particular suitability of the phosphonic acid derivatives for the uses here contemplated is due not only to their peptizing, dispersing, and complexing action, but also to their compatibility with the tanning chemicals and auxiliaries of the prior art, and especially to their extraordinary resistance to hydrolysis under extreme environmental conditions, for example with extreme pH values in the acid and alkaline ranges.

The polyphosphates frequently used in the industry are susceptible to hydrolysis and are not innocuous ecologically. While the conventional organic complexing agents are generally hydrolytically stable, they have no dispersing action, and some of them inhibit enzymatic reactions.

It should be noted that the phosphonates have pronounced complexing properties for heavy metal cations, which act as enzyme poisons. The complex formation constants of $10^{14}$ to $10^{16}$ for these cations are ten powers of ten higher than for $Ca^{2+}$ions. $Fe^{3+}$ions, which are responsible for undesirable flocculation in the case of vegetable tanned leathers, are also effectively complexed.

The complexing capacity is usually determined by titration of a solution of a complexing agent containing soda with a standard calcium acetate solution to permanent turbidity at pH 11–12. (See Ullmanns Enzyklopaedie der technischen Chemie, 4th ed., vol. 24, page 93, Verlag Chemie, 1983, and G. Jacobi & M. Schwuger, Chem. Z. 99, 182–193 [1975].)

In the enzymatic process operations in accordance with the present invention, conventional additives such as activators, stabilizers, etc., may be used in the enzymatic reaction. The proteolytic activity of enzymes is usually determined by the Anson hemoglobin method (M. L. Anson, J. Gen. Physiol. 22, 79 [1939]) or by the Loehlein-Volhard method ("Die Loehlein-Volhard'sche Medhode zur Bestimmung der proteolytischen Aktivitat", Gerbereichem. Taschenbuch, Dresden-Leipzig, 1955) and expressed in LVU's (Lohlein-Volhard unites). An LVU is the amount of enzyme that will digest 1.725 mg casein under the specific conditions of the method.

The examples which follow will serve to illustrate the process of the invention.

The percentages given for the products used are weight percentages.

EXAMPLE 1

Dirt-loosening soaking for the manufacture of shoe upper leathers.

Starting material

Salted German cowhides (black-and-white); salted weight, 1000 kg. (Percentages given below are based on the salted weight.)

Dirt-loosening soaking (drum)

150% of water, 28° C., 0.15% of a 35% solution of the sodium salt of diethylenetriamine pentamethylene phosphonic acid, and 0.4% of nonionic surfactant, e.g., nonylphenol etherified with 8.5 moles of ethylene oxide.

Agitate for 60 minutes. Specific gravity, 5.5° Be; pH of liquor, 6.6.

The water absorption of the hides treated with surfactant and phosphonic acid compound is about 10% more rapid than without the addition of any auxiliaries and as good as when 0.1% of surfactant alone is used. The effluent from the dirt-loosening soak contains from 15 to 30% more substances capable of sedimentation than an effluent not treated with phosphonate.

The COD value of an effluent from a dirt-loosening soak to which phosphonate had been added was 5,230 mg $O_2$/liter, for example, as against 10,460 mg $O_2$/1 in an operation without phosphonate.

EXAMPLE 2

Main soak of cowhides for the manufacture of shoe upper leathers.

Starting Material

Presoaked or cleaned German cowhides (Percentages given below are based on salted weight of 1000 kg.)

Main Soak (Drum):

150.0% of water, 20° C., 0.25% of bacterial protease with activators, 4,500 LVU/g 0.5% of caustic soda solution, 33%, 1:5, 0.25% of the sodium salt of diethylenetriamine pentamethylene phosphonic acid, and 0.5% of nonionic surfactant, namely nonylphenol etherified with 8.5 moles of ethylene oxide. Keep in motion for 4 hours. Gravity, 6°–7° Be; end pH 9.5. Water absorption is about 10 to 15% faster than in an operation without surfactant and phosphonate. The fat content of the soak liquor is 1.82 g/l as compared with 1.37 g/l for a purely enzymatic soak liquor without additives. As in the dirt-loosening soak, sludge sedimentation is better here, too, with a phosphonate addition, which manifests itself in a lower COD value.

EXAMPLE 3

Liming of soaked cowhides for the manufacture of shoe upper leathers.

Starting material

Enzymatically soaked German cowhides. (Percentages given below are based on a salted weight of 1000 kg.)

Liming (Drum)

30.0% of water, 27° C.,
1.5% of sodium sulfide, 60%,
1.2% of an alkyl mercaptan reducing agent,
3.0% of hydrated lime, powdered,
0.5% of caustic soda solution, 33%, 1:5,
0.1% of the sodium salt of diethylenetriamine pentamethylene phosphonic acid, as a 32% aqueous solution.

Agitate for 60 minutes, allow to stand for 15 minutes, then agitate for 15 minutes and allow to stand for 15 minutes. When hair is gelatinized: 100% of water, 26° C., Agitate for 15 minutes, pH 12.5. Agitate for 5 minutes every hour overnight. Morning, pH 12.3, discard liquor.

This process yields pelts that are freer of scud than when no phosphonate is used. The calcium content of the pelts treated with phosphonate is from 10 to 15% lower than when no phosphonate is added. Sedimentation of the lime baths is also improved, which manifests itself in a COD value that is at least 10% lower.

EXAMPLE 4

Prevention of lime blasts on freshly limed cow pelts.

Starting material

Freshly limed cattle pelts from cowhides. Pelt weight, 1000 kg. (Percentage given below are based on the salted weight.)

Lime Rinse Bath (Drum)

200% of water, 25° C.
0.03% of the sodium salt of diethylenetriamine pentamethylene phosphonic acid. Agitate for 10 minutes at 25° C. After exposure to carbon dioxide for one hour followed by superficial air drying, the pelts treated with phosphonate exhibited no lime blasts on the finished crust leather.

EXAMPLE 5

Deliming of cow pelts for the manufacture of shoe upper leathers.

Starting material

Limed, fleshed, split cattle pelts from cowhides. Split thickness, 2 mm. Pelt weight, 1000 kg.

Deliming (Drum)

50% of water, 30° C.,
3.5% of a mixture of 300 parts by weight of diethylenetriamine pentamethylene phosphonic acid (as a 50% aqueous solution) and 123 parts by weight of $NH_3$ (25%); pH in the bath after 5 minutes, 5.1; no acid swell. Keep in motion for 2 hours. End pH, 8.3. Testing of cross section with a phenolphthalein solution: 95 to 100% colorless.

The pelts delimed with phosphonates show uniform coloration in the crust, good softness, and improved freedom from scud by comparison with pelts delimed conventionally, for example with $(NH_4)SO_4$.

EXAMPLE 6

Bating of delimed cowhide pelts for the manufacture of shoe upper leathers.

Starting material

Delimed, split cowhide pelts. Split thickness, 2 mm. (Percentages given below are based on a pelt weight of 1000 kg.)

The operation is carried out in a 50% float from deliming.

Bate (Drum)

+100% of water, 33° C.,
1.0% of pancreatic enzyme with 870 LVU/g
0.5% of nonionic surfactant, e.g. nonylphenol etherified with 8.5 moles of ethylene oxide,
0.25% of the sodium salt of diethylenetriamine pentamethylene phosphonic acid pH 8 to 8.5. Keep in motion for 45 minutes. The pelts bated with phosphonate and surfactant have less scud and their fat content is 10% lower than that of pelts bated without the addition of phosphonate.

EXAMPLE 7

Pickling of bated cowhide pelts for the manufacture of shoe upper leathers.

Starting material

Bated and delimed cowhide pelts. Split thickness, 2 mm. (Percentages given below are based on a pelt weight of 1000 kg.)

Pickle (Drum)

70.0% of water, 22° C.,
7.0% of common salt; specific gravity, over 5.5° Be, Agitate for 10 minutes
0.5% of formic acid, tech., 85% (1:5),
0.4% of sulfuric acid, tech., 98% (1:10), and
0.1% of aminotrimethylene phosphonic acid, 45%. Pelt cross section tested with bromocresol green solution after agitation for 150 minutes; uniformly yellow, pH3. The pelts pickled with phosphonate have a fine, very good, and smooth grain in the crust condition.

EXAMPLE 8

Chrome tanning of pickled cowhide pelts for the manufacture of shoe upper leathers.

Starting material

Pickled cowhide pelts. Split thickness, 2 mm. Pelt weight, 1000 kg. (Percentages given below are based on the pelt weight.)

Chrome tannage (drum)

Tanning may be carried out in a 70% float from pickling.
7.0% of a self-basifying chrome tanning agent comprising 30% of chromium oxide and a basicity of 50%
1.0% of a cationic synthetic paraffinic fatliquoring agent (about 30%) and
0.2% of hydroxyethane-1,1-diphosphonic acid disodium salt. 22° C.; agitate for 60 minutes 0.05% of a 30% aqueous emulsion of 2-(thiocyanomethylthio)benzothiazole (as a curing agent for wet blues). Agitate for 60 minutes, then agitate another 60 minutes at 40° C. and allow to stand for 60 minutes. End pH, 3.8. The leathers are stable to boiling. The leathers tanned with the addition of phosphonate exhibit a firm, full, and smooth grain. The exhaustion of the chrome tanning agents shows a 15% improvement.

EXAMPLE 9

Neutralization and retannage of cowhide wet blues for the manufacture of shoe upper leathers.

Starting material

Shaved and washed wet blues from cowhides. Shaved thickness, 1.5 mm. Shaved weight, 1000 kg. (Percentages given below are based on the shaved weight).

Neutralization (Drum)

200% of water, 37° C., 1.0% of sodium bicarbonate, 0.1% of the sodium salt of diethylenetriamine pentamethylene phosphonic acid, 35%, 0.6% of an anionic phenol-formaldehyde condensation product with a condensation degree of 4–6 (90%) as a leveling agent, and 2.0% of an amphoteric condensation product of a polycarboxylic acid and an amine (96%) as neutralizing retanning agent Keep in motion for 60 minutes. Test of cross section with bromocresol green solution: 100% blue. pH, 5.5 to 6.0 without change of float.

Retannage (Drum)

+1.0% of the sodium salt of a polyacrylic acid having a molecular weight of 20,000 (by solution viscosity) as a retanning agent. Keep in motion for 30 minutes. The leathers neutralized and retanned with the addition of phosphonate exhibit uniform coloration and a firm grain. Intensification of the color is observed, especially with brown dyes.

EXAMPLE 10

Dyeing of retanned cowhide wet blues for the manufacture of shoe upper leathers.

Starting material

Retanned wet blues from cowhides. Shaved thickness, 1.5 mm. Shaved weight, 1000 kg. (Percentages given below are based on the shaved weight).

Dyeing (Drum)

100% of water, 35° C., and 0.05% of the disodium salt of hydroxyethane-1,1-diphosphonic acid Keep in motion for 15 minutes.

1.5% of anionic brown dye.

Keep in motion for 30 minutes.

1.0% of a powdered anionic condensation product of urea and dicyandiamide as a resin tanning agent, and 1.0 % of wattle (mimosa) vegetable tanning extract.

Keep in motion for 30 minutes. ]N. B. In dyeing, metal complex dyestuffs can only be used with reservation since the strong complexing properties of the phosphonates may cause loss of lightfastness[.

Top Dyeing (Drum)

100% of water, 60° C., 0.01% of the disodium salt of hydroxyethane-1,1-diphosphonic acid, and 0.8% of formic acid, 85% (1:5). The leathers dyed with the addition of phosphonate are dyed more evenly and deeper and exhibit better dye penetration and less grain stretch than leathers without phosphonate addition.

EXAMPLE 11

Fatliquoring of Aniline Dyed Cowhide Crust Wet Blues for the Manufacture of Shoe Upper Leathers.

Starting Material

Dyed cowhide wet blues. Shaved thickness, 1.5 mm. Shaved weight, 1000 kg. (Percentages given below are based on the shaved weight.)

Fatliquoring (Drum)

200% of water, 60° C. and 0.02% of the disodium salt of hydroxyethane-1,1-diphosphonic acid.

Keep in motion for 20 minutes. Addition of a 1:10 emulsion (60° C.) of 5% of an anionic synthetic fatliquoring agent (70%, with an emulsifying fraction of 26% and an emulsified fraction of 44%), 3% of sulfonated marine animal oil (80%, with an emulsifying fraction of 35% and an emulsified fraction of 45%), and 2% of an anionic synthetic fatliquoring agent comprising esters of long-chain alcohols and modified ethylene oxide adducts pH 3.8 to 4.3. Keep in motion for 45 minutes.

The phosphonate (0.01 to 1%) may optionally be coemulsified in the fatliquoring mixture. The leathers fatliquored with the addition of the phosphonate show homogeneous through fatliquoring and have a soft, supple feel.

What is claimed is:

1. In a method for making leather from animal skins or hides in one or more wet processing steps employing a surfactant, the improvement wherein all or part of said surfactant is replaced by a phoshonic acid compound of the formula

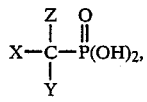

wherein (A) Z and Y are hydrogen and

X is

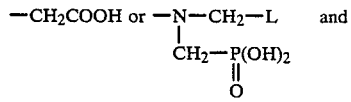

and

L is

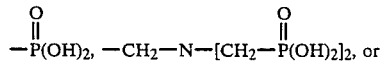

-continued

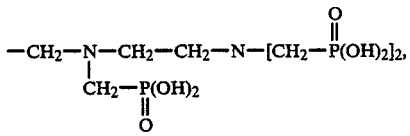

or an ammonium, alkali metal, or alkaline earth metal salt thereof, or wherein (B) Z is alkyl having from 1 to 3 carbon atoms, Y is —OH, and

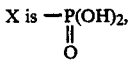

or wherein (C) Z is hydrogen or —COOH,

Y is $—CH_2COOH$, and

X is $—(CH_2)_2—COOH$.

2. A method as in claim 1 wherein said phosphonic acid compound is present in an amount from 0.01 to 5 percent by weight of the hide stock being processed.

3. A method as in claim 1 wherein said phosphonic acid compound is employed in wet processing steps in combination with an enzyme conventionally used in such steps.

4. A method as in claim 1 wherein said wet processing steps are beamhouse operations.

5. A method as in claim 4 wherein said phosphonic acid compound is employed in dirt-loosening and main soaking operations and is present in an amount from 0.01 to 3 percent by weight of the salted skins and hides being processed.

6. A method as in claim 4 wherein said phosphonic acid compound is employed in liming operations and is present in an amount from 0.01 to 3 percent by weight of the salted skins and hides being processed.

7. A method as in claim 4 wherein said phosphonic acid compound is employed in the lime wash water in an amount from 0.01 to 2 percent by weight of the salted skins and hides being processed.

8. A method as in claim 4 wherein said phosphonic acid compound is employed in bating operations and is present in an amount from 0.01 to 5 percent by weight of the pelt being processed.

9. A method as in claim 1 wherein said phosphonic acid compound is employed in pickling operations and is present in an amount from 0.1 to 2 percent by weight of the pelt being processed.

10. A method as in claim 1 wherein said phosphonic acid compound is employed in tanning operations.

11. A method as in claim 10 wherein said phosphonic acid compound is employed in chrome tanning and is present in an amount from 0.01 to 1 percent by weight of the pelt being processed.

12. A method as in claim 10 wherein said phosphonic acid compound is employed in neutralization and is present in an amount from 0.01 to 2 percent by weight of the shaved pelts being processed.

13. A method as in claim 1 wherein said phosphonic acid compound is employed in retanning operations and is present in an amount from 0.01 to 2 percent by weight of the shaved pelts being processed.

14. A method as in claim 1 wherein said phosphonic acid compound is employed in dyeing operations and is present in an amount from 0.01 to 1 percent by weight of the shaved pelts being processed.

15. A method as in claim 1 wherein said phosphonic acid compound is employed in wet finishing operations.

16. A method as in claim 15 wherein said phosphonic acid compound is employed in fatliquoring operations and is present in an amount from 0.01 to 5 percent by weight of the shaved pelts being processed.

* * * * *